US005478055A

United States Patent [19]

Kawamura et al.

[11] Patent Number: 5,478,055

[45] Date of Patent: Dec. 26, 1995

[54] SLIDE GATE PLATE FOR CASTING AND METHOD FOR MOUNTING AND REMOVING THE SAME

[75] Inventors: Toshio Kawamura, Takahama; Shogo Mizutani, Fuchuu; Akira Sato, Okazaki; Kenichi Tsujimoto, Kariya; Yuuichi Kanai, Kariya; Mitsumasa Hasegawa, Kariya; Kenzo Hayashi, Okazaki, all of Japan

[73] Assignee: Toshiba Ceramics Co., Ltd., Tokyo, Japan

[21] Appl. No.: 291,561

[22] Filed: Aug. 16, 1994

[30] Foreign Application Priority Data

Sep. 14, 1993 [JP] Japan ..... 5-250942

[51] Int. Cl.[6] ..... B22D 41/34

[52] U.S. Cl. ..... 266/236; 222/600

[58] Field of Search ..... 266/236; 222/600, 222/590

[56] References Cited

FOREIGN PATENT DOCUMENTS

| | | | |
|---|---|---|---|
| 0577834 | 1/1994 | European Pat. Off. | 222/600 |
| 0112162 | 8/1980 | Japan | 222/600 |
| 2017299 | 10/1992 | WIPO | 222/600 |

*Primary Examiner*—Scott Kastler
*Attorney, Agent, or Firm*—Foley & Lardner

[57] ABSTRACT

In a slide gate plate apparatus for casting to be installed at an outlet of a molten metal vessel, one or two fixed plates and one slide plate are retained integrally by retaining means through a shell wound round the side face of the fixed plate(s) and a shell wound round the side face of the slide plate. In this retained state, the fixed plate(s) and the slide plate are mounted together to a predetermined position of the molten metal vessel.

14 Claims, 4 Drawing Sheets

SLIDE GATE PLATE FOR CASTING AND METHOD FOR MOUNTING AND REMOVING THE SAME

The present invention relates to a slide gate plate apparatus for casting to be installed at an outlet of a molten metal vessel to control the amount of flowing-out molten metal, as well as a method for mounting and removing the same.

PRIOR ART

According to the prior art, in loading a slide gate plate to a molten metal vessel, the slide gate plate is mounted beforehand into a slide gate apparatus body having a weight of one ton or so, the slide gate apparatus body and the slide gate plate being constituted in the form of a cassette or cartridge, and the cassette or the cartridge is loaded to an outlet portion formed at the bottom of the molten metal vessel (see, for example, Japanese Utility Model Publication No. 32569/74).

Such a cassette or a cartridge is provided in a large space beforehand in a large number for replacement purpose, and when there arises the necessity of replacement, it is loaded to a predetermined position of the molten metal vessel by the use of a large-sized apparatus such as a manipulator. Such a pre-assembling work has been conducted as an off-line operation, while the loading/unloading work as an on-line operation.

Also has been adopted a method wherein the slide gate apparatus body is fixed to an outlet portion at the bottom of the molten metal vessel and only the slide gate plate is replaced in an on-line manner.

In the conventional on-line type slide gate plate replacing method, fixed plates and slide plates are replaced one by one. For example, in the case of a tundish including six slide gate apparatus each comprising two fixed plates and one slide plate which are mounted to a slide gate apparatus body, a total of eighteen plates are replaced one by one.

In replacing fixed plates and slide plates one by one, usually two to three minutes are required for the replacing operation. Further, operations associated with the plate replacing work are needed, so when a series of operations are taken into account as a whole, the time required for replacing one fixed plate or slide plate is considerably long. As a result, it becomes difficult to complete the replacing work within a predetermined time which is allowed in an on-line operation, or for avoiding this difficulty it has been necessary to let many workers stand-by in a predetermined position and let them perform the plate replacing work simultaneously.

SUMMARY OF THE INVENTION

Accordingly, it is the object of the present invention to provide a slide gate plate apparatus for casting which permits fixed plate(s) and a slide plate to be replaced easily in a short time in continuous on-line casting, as well as a method for mounting and removing the same.

In one aspect of the present invention there is provided a slide gate plate for casting which is to be installed at an outlet of a molten metal vessel to control the amount of flowing-out molten metal and in which a shell is mounted around the side face of one or two fixed plates and also around the side face of one slide plate, and the fixed plate(s) and the slide plate are retained as a whole by retaining means through the shell of the fixed plate(s) and that of the slide plate.

In another aspect of the present invention there is provided a method for mounting and removing a slide gate plate for casting which is to be disposed at an outlet of a molten metal vessel to control the amount of flowing-out molten metal, the method comprising the steps of retaining one or two fixed plates and one slide plate as a whole by retaining means through a shell provided around the side face of the fixed plate(s) and that around the side face of the slide plate, and thereafter loading the thus-retained fixed plate(s) and slide plate simultaneously to a predetermined position of the molten metal vessel.

EMBODIMENTS

Preferred embodiments of the present invention will be described below with reference to the accompanying drawings.

Figure 1:
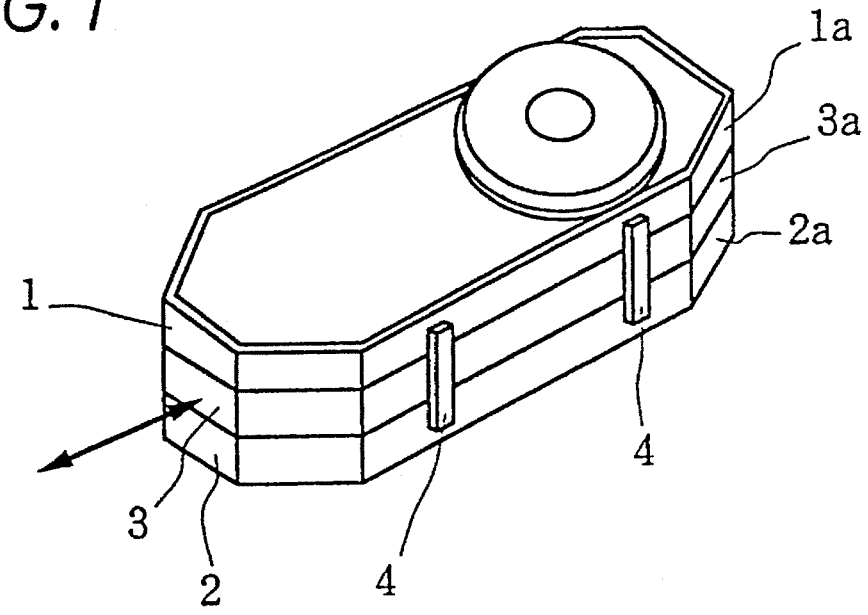
FIG. 1 is a perspective view showing a first embodiment of the present invention.

FIG. 1 illustrates a slide gate plate of a three-layer structure for casting which comprises two fixed plates 1, 2 and one slide plate 3 disposed between the two fixed plates so as to be slidable in the directions of arrows. Shells 1*a*, 2*a* and 3*a* are wound around the side faces of the fixed plates 1, 2 and slide plate 3, respectively. The widths of the shells 1*a*, 2*a* and 3*a* are approximately equal to the thicknesses of the fixed plates 1, 2 and slide plate 3, respectively. Further, iron plates or cushion members may be fixed to the whole of the upper surface of the upper fixed plate and that of the lower surface of the lower fixed plate. Since the shells 1*a*, 2*a* and 3*a* may be mounted in a conventional manner, a detailed description of their mounting method is here omitted.

Four plate- or rod-like retaining members 4 of a narrow width, only two of which are typically shown in FIG. 1, are fixed at both ends thereof to the shell 1*a* of the upper fixed plate 1 and the shell 2*a* of the lower fixed plate 2 by welding. The retaining members 4 are not welded to the shell 3*a* of the slide plate 3 positioned between the fixed plates 1 and 2.

Figure 2:
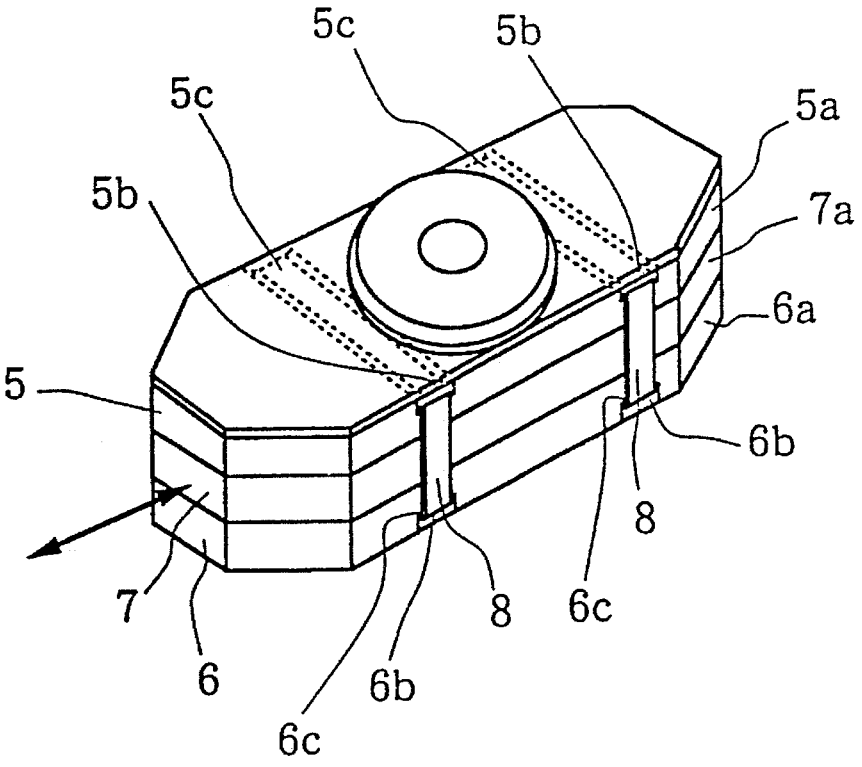
FIG. 2 is a perspective view showing a second embodiment of the present invention.

FIG. 2 shows an example of a slide gate plate of a three-layer structure for casting wherein a single slide plate 7 is provided between an upper fixed plate 5 and a lower fixed plate 6 so as to be slidable in the directions of arrows. Shells 5*a*, 6*a* and 7*a* are fixed around the side faces of the fixed plates 5, 6 and slide plate 7. Iron plates or cushion members may be fixed to the whole of the upper surface of the upper fixed plate and that of the lower surface of the lower fixed plate. Four cut-out portions 5b are formed in the upper end of the shell 5a fixed to the side face of the upper fixed plate 5, and grooves 5c are formed in the upper surface of the upper fixed plate 5 so as to extend between opposed cut-out portions 5b. In a corresponding relation to the cut-out portions 5b there are also formed four cut-out portions 6b in the lower end of the shell 6a fixed to the side face of the lower fixed plate 6, and grooves 6c are formed in the lower surface of the lower fixed plate 6 so as to extend between opposed cut-out portions 5b. Two band-like retaining members 8 are wound around the fixed plates and slide plate so as to pass through the cut-out portions 5b, 6b of the shells 5a, 6a on the plate side faces and also through the grooves 5c, 6c and so as to have a predetermined tensile force in parallel with each other, to retain the fixed plates 5, 6 and slide plate 7 as a whole.

Figure 3:
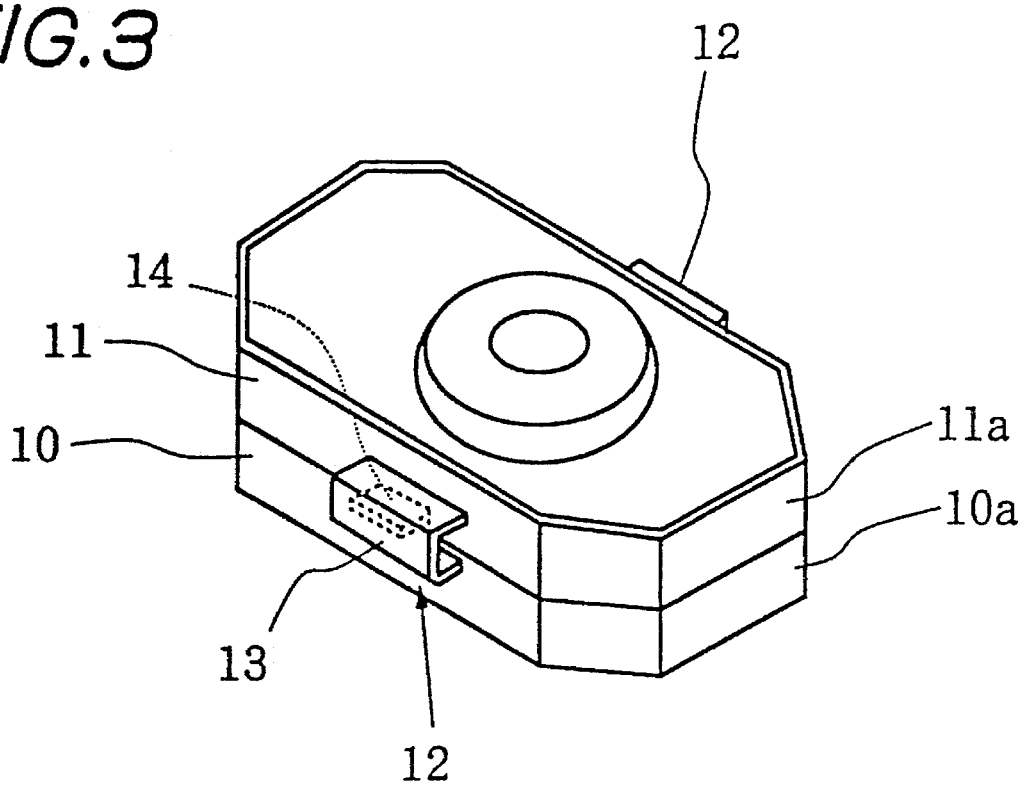
FIG. 3 is a perspective view showing a third embodiment of the present invention.
Figure 4:
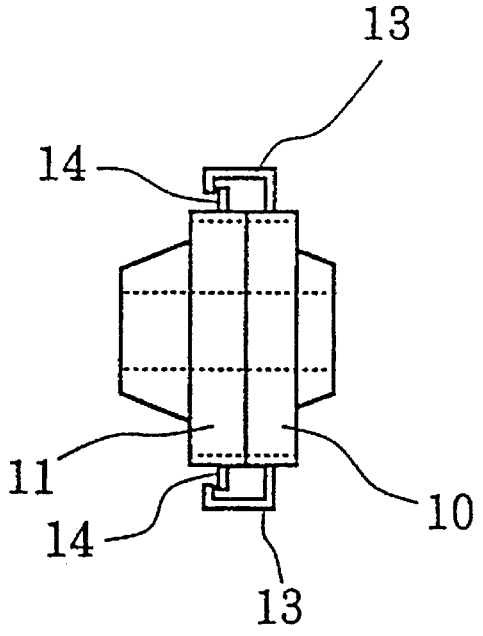
FIG. 4 is an end view thereof.
Figure 5:
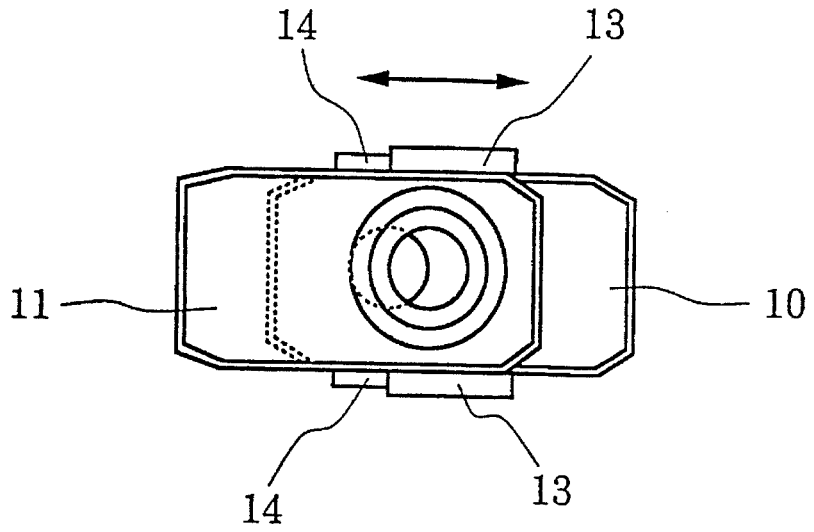
FIG. 5 is a plan view showing a shifted state of a slide plate in a predetermined direction from an overlapped state thereof with a fixed plate illustrated in FIG. 3.

FIGS. 3, 4 and 5 show an example of a slide gate plate of a two-layer structure comprising one fixed plate 11 and one slide plate 10. Shells 11a and 10a are wound and fixed around the side faces of the fixed plate 11 and slide plate 10, respectively. A pair of retaining members 12 are provided in nearly central, opposed, side positions of the shells 11a and 10a of the fixed plate 11 and slide plate 10. A retaining piece portion 13 provided on the shell 10a of the slide plate 10 is in a bent shape of a thin plate having a generally U-shaped section, while a retaining piece portion 14 fixed to the shell 11a of the fixed plate 11 is in the shape of a flat plate. The slide plate 10 and the fixed plate 11 can be retained together by mutual engagement of the retaining piece portions 13 and 14. FIGS. 3 and 4 illustrate an engaged state of the two, in which the fixed plate 11 and the slide plate 10 are in a superposed condition. FIG. 5 illustrates a slid state of the slide plate 10 in one of the arrowed directions.

Figure 6:
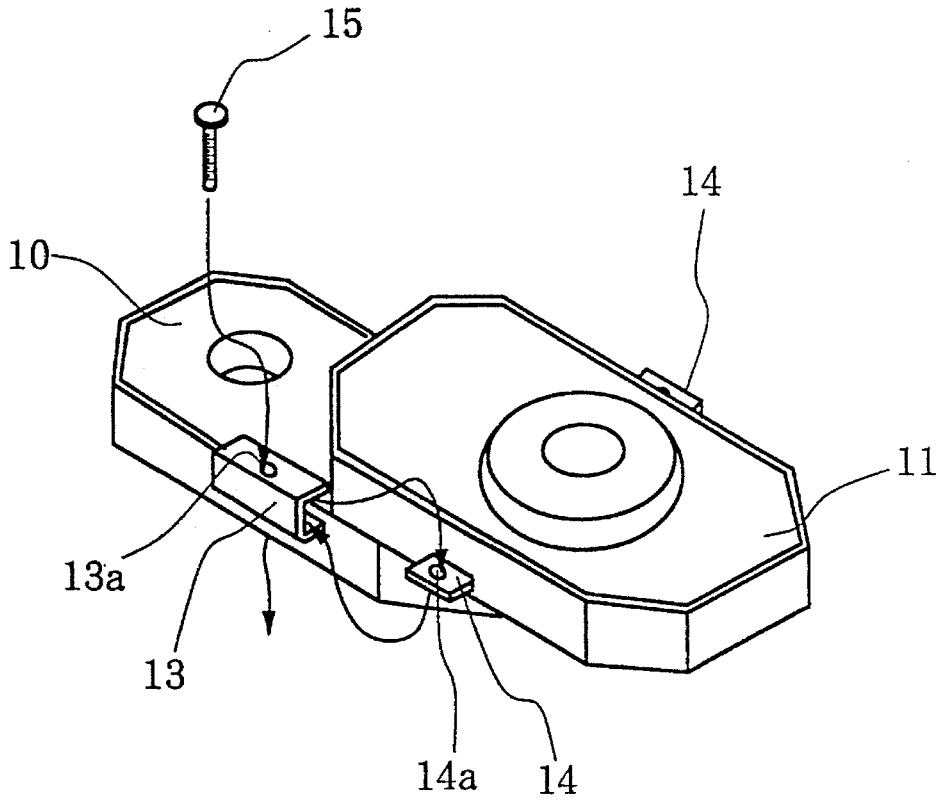
FIG. 6 is a perspective view showing a fourth embodiment of the present invention in which there is illustrated a state corresponding to FIG. 5.

FIG. 6 shows a modification of the embodiment illustrated in FIGS. 3, 4 and 5. In the embodiment shown in FIG. 6, holes 13a and 14a are formed in two retaining piece portions 13 and 14, respectively, and in an aligned state of the holes 13a and 14a, a pin 15 formed of a synthetic resin is inserted through those holes to retain the slide plate 10 and the fixed plate 11 strongly until just before the use. The pin breaks easily upon sliding motion of the slide plate in use.

Alternatively, in the embodiment illustrated in FIG. 6, the pin 15 may be in a form suitable for threaded engagement.

Figure 7:
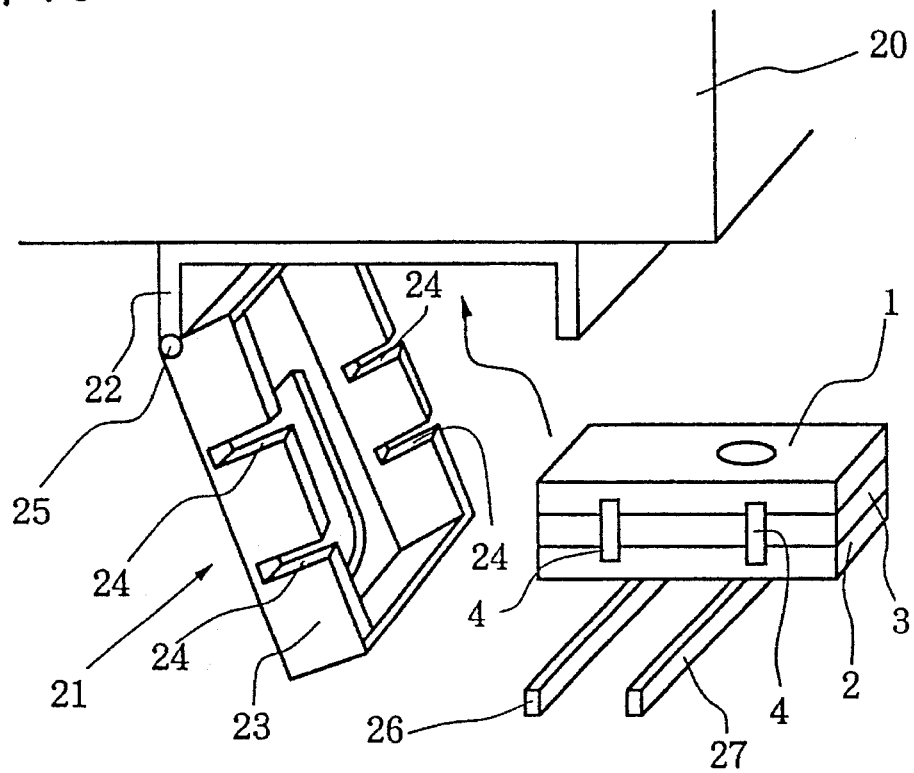
FIG. 7 is an explanatory view showing an example of mounting fixed plates and a slide plate which are illustrated in FIG. 1 to a molten metal vessels and FIG. 8 is an explanatory view showing an example of mounting fixed plates and a slide plate which are illustrated in FIG. 1 to a molten metal vessel.

FIG. 7 shows an example of mounting the slide gate plate of a three-layer structure comprising two fixed plates 1, 2 and one slide plate 3, which is illustrated in FIG. 1, to the bottom of a molten metal vessel 20 in a predetermined position.

In the embodiment shown in FIG. 7, a slide gate apparatus 21 is fixed to the bottom of the molten metal vessel 20 in a predetermined position. The slide gate apparatus body 21 has a support member 22 fixed to the bottom of the vessel 20 and a casing 23 mounted rotatably to one end of the support member 22. Four cut-in portions 24 are formed at a predetermined spacing in the casing 23. The depth and width of each of the cut-in portions 24 correspond respectively to the total thickness of the fixed plates 1, 2 and slide plate 3 which are retained integrally by the retaining members 4 and the width of each of two fork portions 26 and 27 which support those plates integrally.

For mounting the fixed plates 1, 2 and slide plate 3 to the predetermined position of the molten metal vessel 20, first the casing 23 is released from its retained state and is rotated partially about a rotational center 25 thereof to open it. Next, the integrally retained, fixed plates 1, 2 and slide plate 3 are put onto the fork portions 26 and 27 simultaneously, and in this state they are conveyed to a predetermined position in the slide gate apparatus body 21. Thereafter, the casing 23 is closed and retained by retaining means (not shown). In this retained state, the two fork portions 26 and 27 are in an inserted state into the cut-in portions 24 of the casing. Subsequently, the forks 26 and 27 are moved in their axial direction and pulled out from the cut-in portions 24. In this way the fixed plates 1, 2 and the slide plate 3 are loaded into the slide gate apparatus body 21.

Then, for replacement with new fixed plates and slide plate, the two forks 26 and 27 are inserted into the cut-in portions 24 of the casing 23, thereafter the casing is released from its retained state and is opened, and the two forks 26 and 27 with the fixed plates 1, 2 and slide plate 3 put thereon are conveyed to a predetermined position.

In FIG. 7, a minimum number of required components are shown emphasizedly for simplification of the drawing, but actually there are further provided means for supporting the fixed plates 1, 2 and slide plate 3 under the action of an upward force, a spring or the like for imparting an elastic force to the said means, means for retaining the casing 23, means for sliding the slide plate 3, etc.

Figure 8:
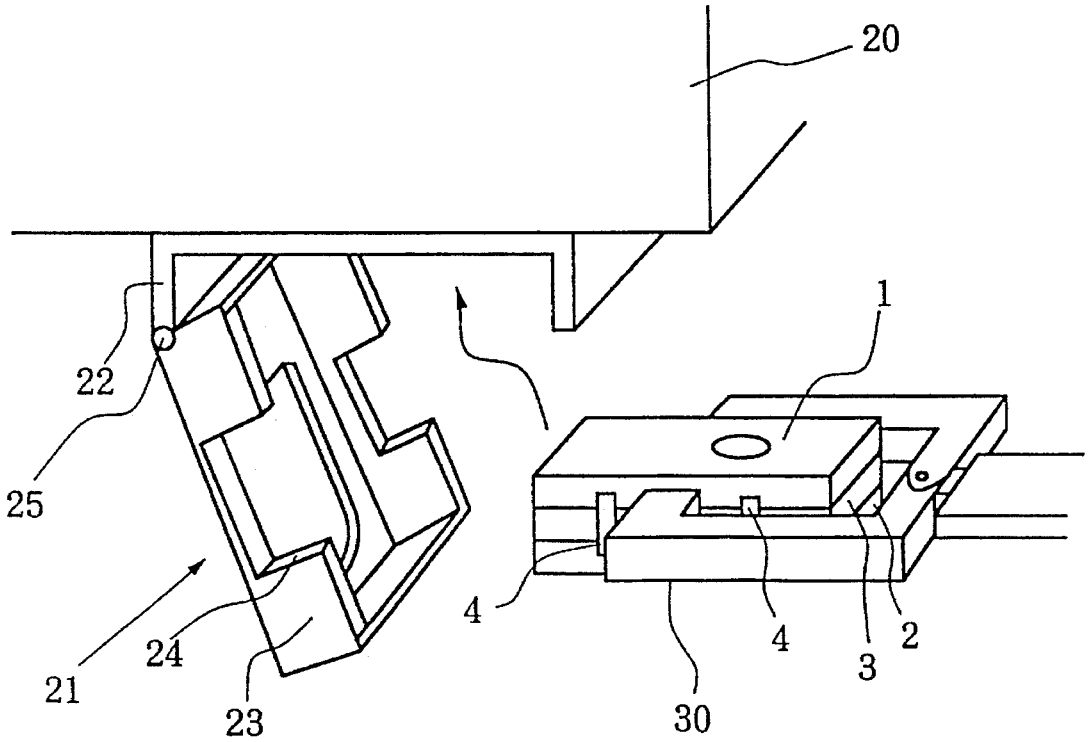

FIG. 8 shows another example of mounting the slide gate plate apparatus of a three-layer structure. In FIG. 8, the slide gate plate is mounted and removed by holding a pair of side surfaces of the entire slide gate plate for casting by robot hand 30 (mechanical hand).

The present invention is not limited to the above embodiments. For example, the retaining means may be welding means, bolting means, fitting means, insertion means or caulking means, and may be in any shape, e.g. band or rod.

Also in loading the fixed plates 1, 2 and slide plate 3 into the slide gate apparatus 21, this loading operation may be done using physical means for holding the those plates which means is provided within the slide gate apparatus, even without using the fork portions 26 and 27. A fixing method using a negative pressure or using a magnetic force can also be adopted.

According to the present invention, since the retaining means can be made extremely simple and light-weight in its structure, the total weight of fixed plate(s), slide plate and retaining means can be greatly reduced to, say, several ten kilograms. Consequently, it is no longer required to use such a large-sized apparatus as in the prior art at the time of mounting the slide gate plate to the molten metal vessel. Further, it becomes easier to effect the mounting operation using a robot, whereby the working efficiency is improved to a great extent.

According to the present invention, moreover, the replacement of the slide gate plate can be done easily in an on-line operation, and also from this point there is attained an improvement of the working efficiency. Usually, in continuous casting of iron and steel, a plurality of tundishes are provided and changed from one to another at the end of a predetermined casting operation, in order to enhance the productivity of the continuous casting machine. In this case, it is necessary that the stand-by tundish or tundishes be kept preheated over a long time, and therefore a large volume of combustion gas is consumed. The use of the slide gate plate according to the present invention permits replacement of the plate in a short time since there is performed a slag removing operation for tundish in a hot condition, thus resulting in that the tundish can be used continuously in a large number of times without replacement thereof, that is, it is no longer necessary to cool the molten metal vessel. In this case, the energy efficiency is greatly improved.

The present invention is also applicable to an automatic plate replacement using a robot or the like.

We claim:

1. A slide gate plate apparatus for casting to be installed at an outlet of a molten metal vessel to control the amount of flowing-out molten metal, said apparatus comprising:

at least one fixed plate having a peripheral side, a slide plate adjacent to said at least one fixed plate and having a peripheral side a first shell fixed around the peripheral side of said at least one fixed plate, a second shell fixed around the peripheral side of said slide plate, a retaining means attached to said first and second shells so that said at least one fixed plate and said slide plate are retained via said first and second shells by said retaining means in such a manner that said slide plate can slideably move relative to said at least one fixed plate; and means fixed to said molten metal vessel for supporting said one or two at least one fixed plates, said slide plate and said first and second shells together in position at the outlet of said molten metal vessel, said means for supporting being fixed to the molten metal vessel.

2. A slide gate plate apparatus for casting according to claim 1, wherein said supporting means includes a support member fixed to a bottom portion of said vessel and a casing attached to said support member in such a way that said support member and said casing in combination can retain and support said at least one fixed plates, said slide plate and said first and second shells together in position.

3. A slide gate plate apparatus for casting according to claim 1, wherein all of said at least one fixed plate, said slide plate and said first and second shells together are attached to said supporting means at the outlet of the vessel by a robot.

4. A slide gate plate apparatus for casting according to claim 1, wherein said retaining means is a band.

5. A slide gate plate apparatus for casting according to claim 1, wherein said retaining means is a rod or a plate.

6. A slide gate plate apparatus for casting according to claim 1, wherein said retaining means includes a channel member having a U-shaped cross section and a retaining piece portion.

7. A method for mounting and removing a slide gate plate apparatus for casting to be installed at an outlet of a molten metal vessel, said method comprising the steps of:

fixing a first shell around a peripheral side of at least one fixed plate, fixing a second shell around a peripheral side of a slide plate, retaining said at least one fixed plate and said slide plate integrally by a retaining means, and mounting the thus-retained at least one fixed plate and said slide plate together to a supporting means at the outlet of said molten metal vessel.

8. A method according to claim 7, wherein all of the plates are mounted on said supporting means and removed from said supporting means by a fork.

9. A method according to claim 7, wherein all of the plates are mounted on said supporting means and removed from said supporting means by a robot.

10. A slide gate plate apparatus according to claim 1, wherein all of said at least on fixed plate, said slide plate and said first and second shells together are mounted on and removed from said supporting means at the outlet of the vessel by a fork.

11. A slide gate plate apparatus according to claim 2, wherein all of said at least one fixed plate, said slide plate and said first and second shells together are mounted on and removed from said supporting means at the outlet of the vessel by a robot.

12. A slide gate plate apparatus according to claim 2, wherein all of said at least one fixed plate, said slide plate and said first and second shells together are mounted on and removed from said supporting means at the outlet of the vessel by a fork.

13. A slide gate plate apparatus according to claim 1, wherein said at least one fixed plate comprises two fixed plates disposed on opposite sides of said sliding plate.

14. A method according to claim 7, wherein the step of fixing a first shell further comprises fixing a first shell to two fixed plates and the step of retaining further comprises retaining said slide plate with said two fixed plates.

* * * * *